US011508322B1

(12) United States Patent
Sheikh et al.

(10) Patent No.: US 11,508,322 B1
(45) Date of Patent: Nov. 22, 2022

(54) METHOD AND SYSTEM FOR DYNAMICALLY SETTING BACKLIGHT DIMMING ALGORITHM FOR DISPLAYS

(71) Applicant: Dell Products L.P., Round Rock, TX (US)

(72) Inventors: Shohrab Sheikh, Singapore (SG); Ben Jin Tan, Singapore (SG)

(73) Assignee: Dell Products L.P., Round Rock, TX (US)

( * ) Notice: Subject to any disclaimer, the term of this patent is extended or adjusted under 35 U.S.C. 154(b) by 49 days.

(21) Appl. No.: 17/337,796

(22) Filed: Jun. 3, 2021

(51) Int. Cl.
*G09G 3/34* (2006.01)
*G09G 5/10* (2006.01)

(52) U.S. Cl.
CPC ..... *G09G 3/342* (2013.01); *G09G 5/10* (2013.01); *G09G 2320/0233* (2013.01); *G09G 2320/0646* (2013.01); *G09G 2360/16* (2013.01)

(58) Field of Classification Search
CPC ..... G09G 3/342; G09G 5/10; G09G 2360/16; G09G 2320/0646; G09G 2320/0233
See application file for complete search history.

(56) References Cited

U.S. PATENT DOCUMENTS

2011/0316829 A1* 12/2011 Oka ..... G09G 3/3426 345/207
2012/0007896 A1* 1/2012 Kwon ..... G09G 3/3426 345/102
2014/0085360 A1* 3/2014 Ohno ..... G09G 3/36 345/694
2014/0368558 A1* 12/2014 Ikeda ..... G09G 3/3426 345/87
2020/0135074 A1* 4/2020 Wooster ..... G09G 3/3426

* cited by examiner

*Primary Examiner* — Rodney Amadiz
(74) *Attorney, Agent, or Firm* — Terrile, Cannatti & Chambers, LLP; Emmanuel A. Rivera

(57) ABSTRACT

A system, method, and computer-readable medium are disclosed for reducing halo artifacts of static images on a computer display. A multimedia stream is received that includes graphical images which are moving and static images as displayed on the computer display. A determination is performed if a graphical image in the multimedia stream is a static image. Additional LED zones of LEDs are turned on to provide backlighting to a computer display panel. A diming algorithm is enabled to adjust LEDs to reduce halo artifacts in the static image. Luminance correction is performed at the pixel level for the static image.

20 Claims, 5 Drawing Sheets

METHOD AND SYSTEM FOR DYNAMICALLY SETTING BACKLIGHT DIMMING ALGORITHM FOR DISPLAYS

BACKGROUND OF THE INVENTION

Field of the Invention

The present invention relates to computer systems. More specifically, embodiments of the invention relate to dynamically setting a backlight local dimming algorithm between static and moving graphics images.

Description of the Related Art

Liquid crystal displays (LCD), such as those used for computer monitors, can implement the use of liquid emitting displays (LED) for backlighting. There can be thousands of individual LEDs arranged in multiple zones (multi-zone) to provide such backlighting.

LEDs can be arranged in various techniques for backlighting, such as local dimming, where LED clusters, arranged in zones (e.g., rectangles, rows or columns) are individually controlled. The local dimming arrangement can be used to dynamically control level of light intensity of specific areas of darkness on a screen, which can result in higher dynamic contrast ratios.

Halation effect is light leakage from surrounding white areas that can corrupt black (dark) areas of the screen. Consideration and the use of algorithms as to a local dimming arrangement can address the halation effect. Halo artifacts are color tinting that can be found at edges of images. Therefore, implementing a proper algorithm that controls LEDs in a local dimming arrangement can reducing halo artifacts.

Typically, such algorithms that address the halation effect and halo artifacts are directed to moving graphic images, where frames successively change (e.g., movies and videos). In the case of static images where frames do not change (e.g., a computer monitor displaying a static image), halo artifacts may be present, such as color tinting at the edges of static images visible on white colored images, since the algorithm does not address such issues with static images.

SUMMARY OF THE INVENTION

A system, method, and computer-readable medium are disclosed for reducing halo artifacts of static images on a computer display. A multimedia stream is received that includes graphical images which are moving and static images as displayed on the computer display. A determination is performed if a graphical image in the multimedia stream is a static image. Additional LED zones of LEDs are turned on to provide backlighting to a computer display panel. A diming algorithm is enabled to adjust LEDs to reduce halo artifacts in the static image. Luminance correction is performed at the pixel level for the static image.

BRIEF DESCRIPTION OF THE DRAWINGS

The use of the same reference number throughout the several figures designates a like or similar element. The present invention may be better understood, and its numerous objects, features, and advantages made apparent to those skilled in the art by referencing the accompanying drawings, wherein.

DETAILED DESCRIPTION

A system, method, and computer readable medium are disclosed for providing an optimum algorithm to address the halation effect and reduce halo artifacts in graphical moving and static images. A dimming algorithm is used for graphical moving images and a dimming algorithm is used for graphical static images. Dynamically determining whether an image is moving, or whether the image is static, determines which algorithm to use to optimally address the halation effect and reduce halo artifacts.

Local dimming techniques can be implemented to effectively suppress dark. state light leakage and enhance contrast ratio. Segmented LEDs can be adopted in an LCD backlight unit, such that local LED zones can be independently dimmed to match displayed image contents. Backlight dimming algorithms can be used to control local dimming zones to improve image quality.

For purposes of this disclosure, a device or an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
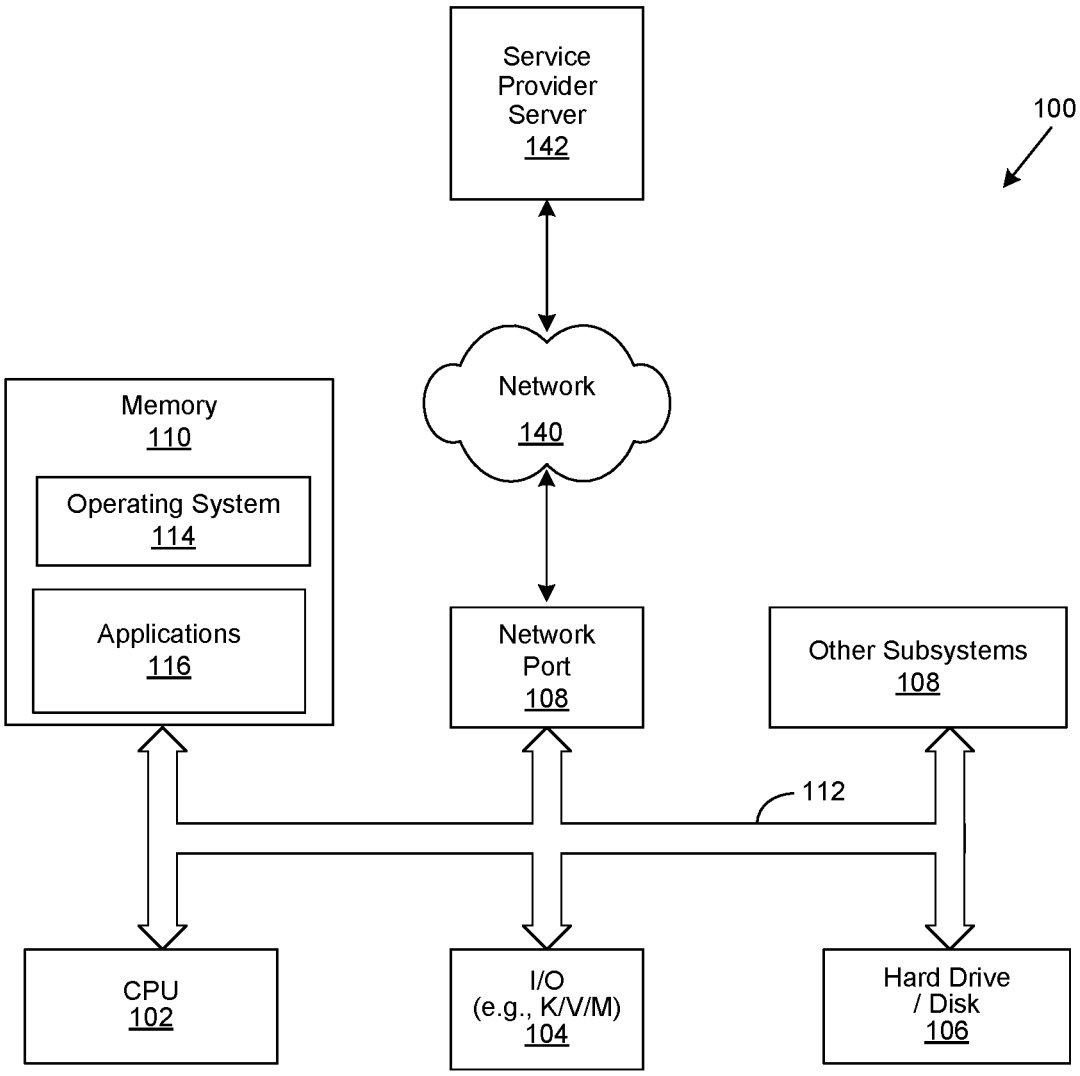
FIG. 1 depicts a general illustration of an example information handling system.

FIG. 1 illustrates an information handling system 100 that can be used with the system and method of the present invention. The information handling system 100 includes one or more processors (e.g., central processor unit or "CPU", embedded controller, etc.) 102, input/output (I/O) devices 104, such as a display (monitor), a keyboard, a mouse, and associated controllers, a hard drive or disk storage 106, and various other subsystems 108. In particular, the display system described herein can be used to implement the methods and systems as described.

In various embodiments, the information handling system 100 also includes network port 108 operable to connect to a network 140, which is likewise accessible by a service provider server 142. The network 140 may be a public network, such as the Internet, a physical private network, a wireless network, a virtual private network (VPN), or any combination thereof. Skilled practitioners of the art will recognize that many such embodiments are possible, and the foregoing is not intended to limit the spirit, scope or intent of the invention.

The information handling system 100 likewise includes system memory 110, which is interconnected to the foregoing via one or more buses 112. Examples of buses 112 include I2C, USB, etc. System memory 110 further includes an operating system (OS) 114 and applications 116. In certain embodiments, applications 116 are provided as a service from the service provider server 142.

Figure 2:
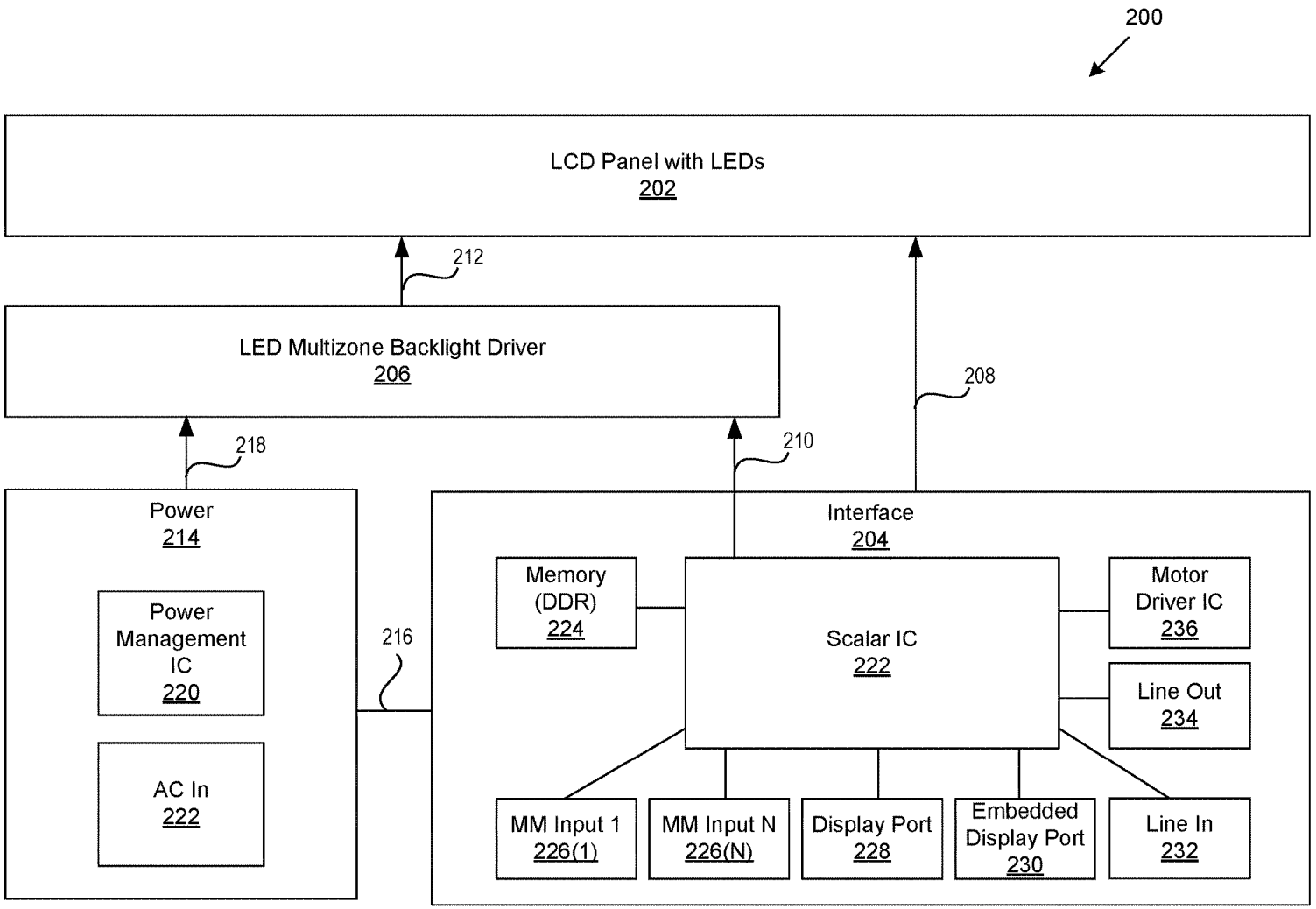
FIG. 2 depicts a general illustration of an example display system as implemented in the system and method of the present invention.

FIG. 2 illustrates a display 200 that can be used with the system and method of the present invention. The display 200 for example can be implemented as a high definition computer monitor. The display 200 can be included as an input/output (I/O) device 104 as described in FIG. 1. In various implementations, the display 200 provides an optimum algorithm to address the halation effect and reduce halo artifacts in graphical moving and static images. Various embodiments provide for the display 200 to include an LCD panel with LEDs 202. In various implementations, LED clusters are grouped in zones (e.g., rectangles, rows or columns) to provide for backlighting. An example arrangement can include local dimming. The LEDs can be individually controlled.

Embodiments provide for an interface or interface board 204 and an LED multizone backlight driver 206. Implementations can provide for the interface board 204 and components of interface board 204 to directly control the LCD panel 202 as shown by control 208. In certain implementations, the interface board 204 and components of interface board 204 provide control 210 to the LED multizone backlight driver 206. The LED multizone backlight driver 206 provides control 212 to the LCD panel 202.

Various embodiments provide for the display 200 to include a power component such as a power interface board 214. Implementations can include for the power interface board 214 to provide power 216 to the interface board 204 and power 218 to the LED multizone backlight driver 206. In various embodiments the power interface board 214 incudes a power management integrated circuit 220 and an alternating current (AC) input 222.

Implementations provide for the interface board 204 to include a processor or processors, such as a scalar integrated circuit (IC) 222. Various busses and connections such as I2C can connect the scalar IC 222 to components on the interface board 204.

The interface board 204 can further include memory 224. The memory represents various memory such as a dynamic read only memory, random access memory, etc. Furthermore, various implementations of memory such as double dynamic data rate (DDR) can be provided.

Implementations provide for the display 200 to receive inputs (i.e., multimedia streams) from the information handling system 100 of FIG. 1.

Implementations further provide for the interface board 204 to include input connections, such as multimedia (MM) inputs 226(1) to 226(N). Examples of MM inputs 226 include high definition media input (HDMI), etc. Other input connections can include for a display port 228 and an embedded display port 230. Implementations can also provide for a line in input 232 and line out output 234. Furthermore, the interface board 204 can include a motor driver integrated circuit (IC) 236.

Figure 3:
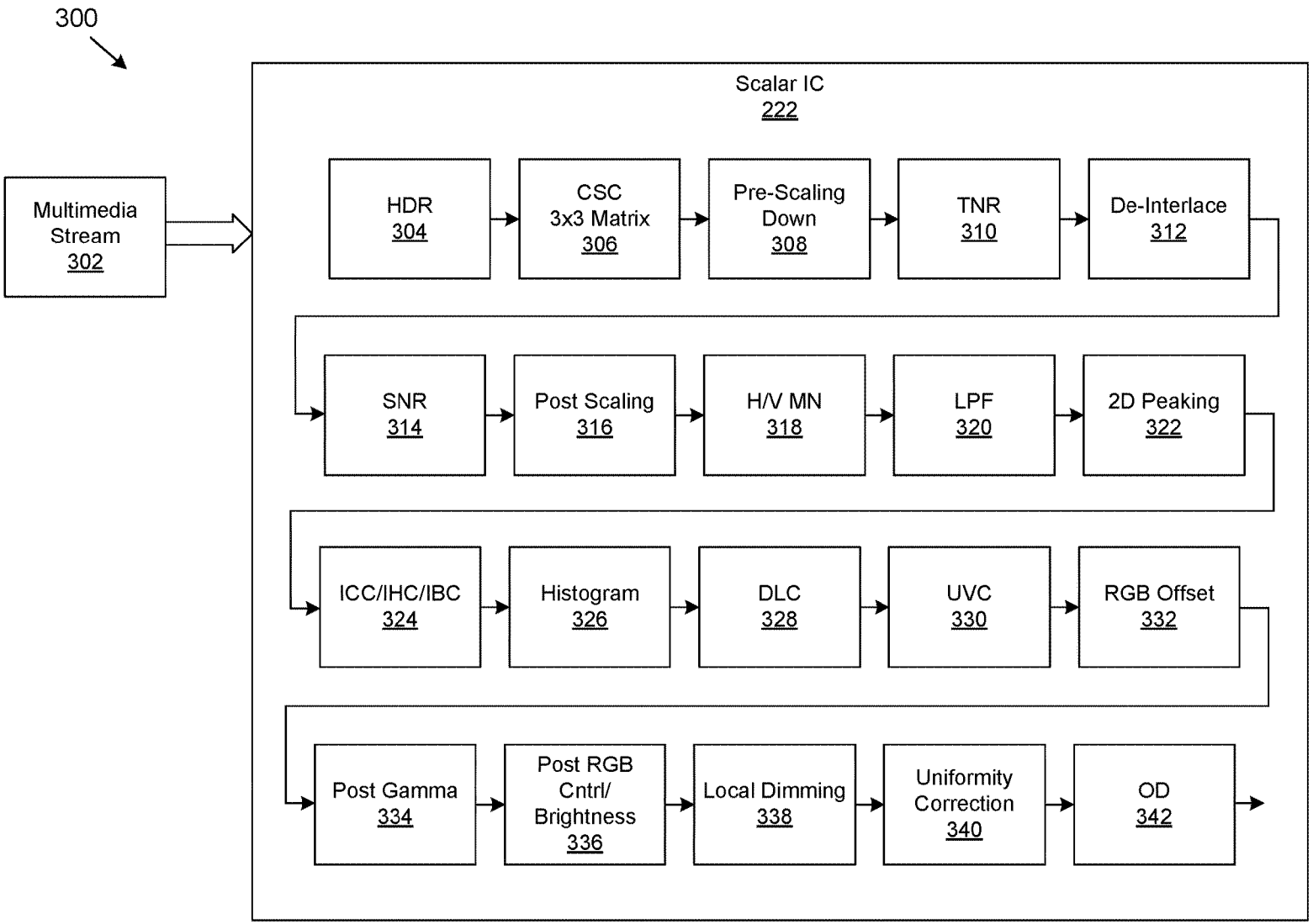
FIG. 3 depicts an example block diagram for receiving and processing multimedia streams.

FIG. 3 shows an example block diagram 300 of the scalar IC 222 receiving and processing multimedia streams. A multimedia stream 302 can be received from various sources, such as the information handling system 100 of FIG. 1. It is to be understood that various standards and protocols can be implemented. The processing described herein is just an example of operations that can be implemented for on multimedia stream 302.

The scalar IC 222 receives the multimedia stream 302. The following are example operations that can be performed on the multimedia stream 302. A high dynamic range (HDR) operation 304 can be performed. A compressed square column (CSC) 3×3 operation 306 can be performed. A pre-scaling down sampling operation 308 can be performed. A temporal noise reduction (TNR) operation 310 can be performed. A de-interlace operation 312 can be performed. A signal to noise reduction (SNR) operation 314 can be performed. A post scaling operation 316 can be performed. An H/V (sync) MN (input)) operation 318 can be performed. A low pass filter (LPF) operation 320 can be performed. A two dimensional (2D) peaking operation 322 can be performed. An ICC/IHC/IBC operation 324 can be performed. A histogram operation 326 can be performed. A DLC operation 328 can be performed. A UVC operation 330 can be performed. An RGB offset operation 332 can be performed. A post gamma operation 334 can be performed. A post RGB control/brightness operation 336 can be performed. A local dimming operation 338 can be performed. A uniformity correction operation 340 can be performed. An overdrive control (OD) operation 342 can be performed.

In determining when to apply an optimum dimming algorithm, an image is identified as either dynamic or static as displayed. In certain implementations, during the histogram operation 326, a histogram is used to compare two successively frames in the multimedia stream 302. No change in two successive frames (i.e., no change as to the histogram), translates to a static image.

A proceeding step is to adjust LED zone(s) to turn "on" more zones to the edge of an image. At local dimming operation 338, an optimal local dimming algorithm is applied to suppress halo artifacts. The algorithm is used to control enabling of individual local LEDs. The next step can be to enhance pixel luminance of the image. At uniformity correction 340, additional pixel based correction can be performed to reduce discoloration. Such a fix can be applied dynamically when a static image is detected. At the uniformity correction block, edges of the images are identified and individual pixel luminance tuning can be performed by the scaler IC 222.

Figure 4:
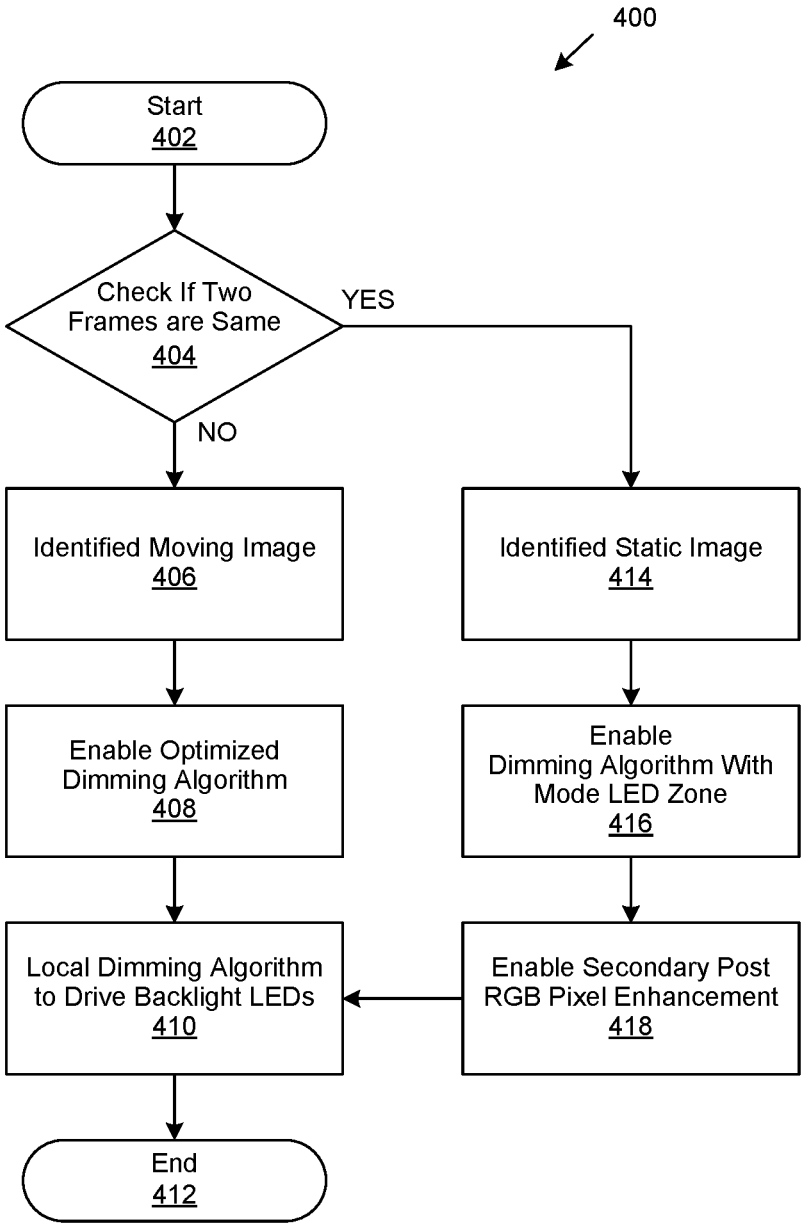
FIG. 4 shows a flow chart for dynamically setting backlight local dimming algorithms between static and moving graphics images.

FIG. 4 is a generalized flowchart 400 for dynamically setting backlight local dimming algorithms between static and moving graphics images. In particular, the process 400 can be used to perform dimming algorithms to address as to dynamic and static images to address the halation effect and to reduce halo artifacts in a display. The order in which the method is described is not intended to be construed as a limitation, and any number of the described method blocks may be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At step 402, the process 400 starts. At step 404, a determination is performed as to whether two consecutive frames are performed. As described when above in FIG. 3, when scalar IC 222 receives a multimedia stream 302, at the histogram operation 326, no change of histogram as to two consecutive frames translates to a static image being shown on the display.

If the determination at step 404 is that two successive frames are not the same, following the "NO" branch of step 404, then at step 406, a graphical moving image is identified. The identification can be performed by the scalar IC 222. At step 408, an optimized dimming algorithm is enabled which can be performed by the scalar IC 222, and control 210 provided to the LED multizone backlight driver 206. The optimized dimming algorithm can be implemented at local dimming operation 338.

At step 410, the local dimming algorithm is enabled to drive the backlight LEDs of the LCD panel with LEDs 202. The scalar IC 222 can enable the local dimming algorithm which is used halo artifacts and controls the enabling of individual local LEDs. At step 412, the process 400 ends.

If the determination at step 404 is that two successive frames are the same, following the "YES" branch of step 404, then at step 414, a graphical static image is identified. The identification can be performed by the scalar IC 222. At step 416, a dimming algorithm with mode LED zone is enabled which can be performed by the scalar IC 222 at local dimming operation 338, and control 210 provided to the LED multizone backlight driver 206.

At step 418, secondary post RGB pixel enhancement is performed, and can be implemented by the scalar IC 222 at uniformity correction 340. This step provides for additional pixel based correction to reduce discoloration.

At step 410, the local dimming algorithm is enabled to drive the backlight LEDs of the LCD panel with LEDs 202. The scalar IC 222 can enable the local dimming algorithm which is used halo artifacts and controls the enabling of individual local LEDs. At step 412, the process 400 ends.

Figure 5:
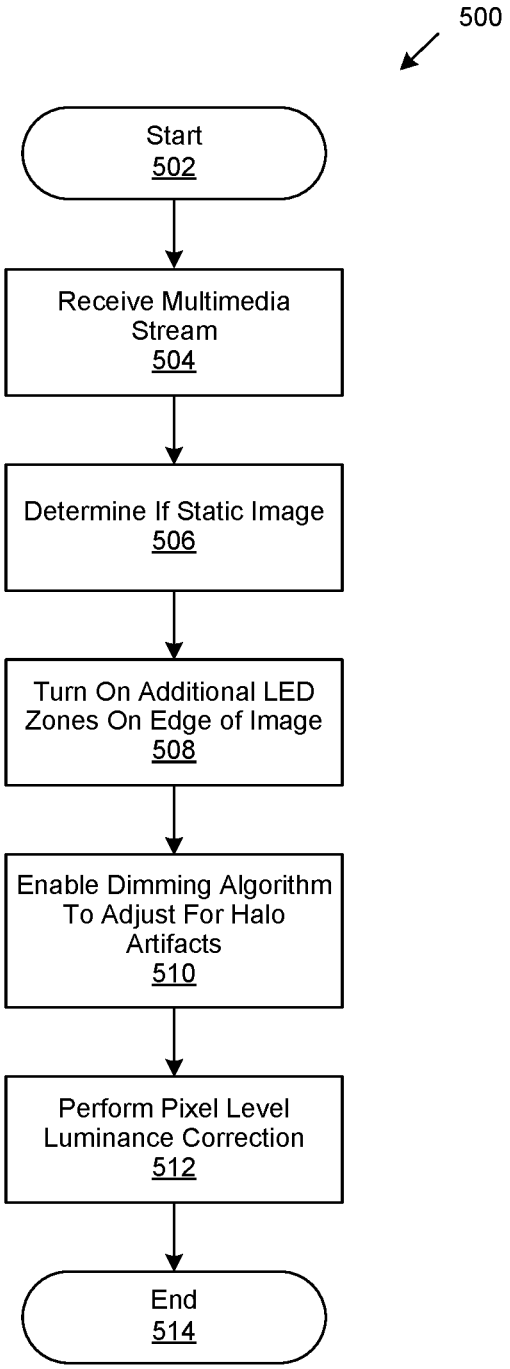
FIG. 5 shows a flow chart for reducing halo artifacts of static images on a computer display.

FIG. 5 is a generalized flowchart 500 for reducing halo artifacts of static images on a computer display. The order in which the method is described is not intended to be construed as a limitation, and any number of the described method blocks may be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At step 502, the process 500 starts. At step 504, a multimedia stream is received. For example, multimedia stream 302 is received by scalar IC 222. The multimedia stream can include graphical moving images where successive frames change, and graphical static images where successive frames do not change.

At step 506, a determination is performed as to whether a graphical image is static. The IC scalar 222 can perform the determination. As an example, histograms representing an image can be compared. If the histogram does not change, a static image is determined.

At step 508, additional LED zones are turned "On" at the edges of an images. The IC scalar 222 can instruct the LED multizone backlight driver 206 to turn on the individual LEDs of particular LED zones that provide backlighting of LCD panel 202.

At step 510, dimming algorithm is enabled to adjust for or suppress halo artifacts. The IC scalar 222 can instruct the LED multizone backlight driver 206 to perform the dimming algorithm. The dimming algorithm controls individual LEDs in clusters or zones of LEDs which provide backlighting for LCD panel 202.

At step 512, luminance correction is performed at the pixel level. LEDs can correspond to a pixel and can be adjusted to provide for the luminance correction. The IC scalar 222 can instruct the LED multizone backlight driver 206 to perform the luminance correction. The pixel correction can be performed to reduce discoloration. At step 514, the process 500 ends.

As will be appreciated by one skilled in the art, the present invention can be embodied as a method, system, or computer program product. Accordingly, embodiments of the invention can be implemented entirely in hardware, entirely in software (including firmware, resident software, microcode, etc.) or in an embodiment combining software and hardware. These various embodiments can all generally be referred to herein as a "circuit," "module," or "system." Furthermore, the present invention can take the form of a computer program product on a computer-usable storage medium having computer-usable program code embodied in the medium.

Any suitable computer usable or computer readable medium can be utilized. The computer-usable or computer-readable medium can be, for example, but not limited to, an electronic, magnetic, optical, electromagnetic, infrared, or semiconductor system, apparatus, or device. More specific examples (a non-exhaustive list) of the computer-readable medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, or a magnetic storage device. In the context of this document, a computer-usable or computer-readable medium can be any medium that can contain, store, communicate, or transport the program for use by or in connection with the instruction execution system, apparatus, or device.

Computer program code for carrying out operations of the present invention can be written in an object oriented programming language such as Java, Smalltalk, C++ or the like. However, the computer program code for carrying out operations of the present invention can also be written in conventional procedural programming languages, such as the "C" programming language or similar programming languages. The program code can execute entirely on the user's computer, partly on the user's computer, as a stand-alone software package, partly on the user's computer and partly on a remote computer or entirely on the remote computer or server. In the latter scenario, the remote computer can be connected to the user's computer through a local area network (LAN) or a wide area network (WAN), or the connection can be made to an external computer (for example, through the Internet using an Internet Service Provider).

Embodiments of the invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only and are not exhaustive of the scope of the invention.

Consequently, the invention is intended to be limited only by the spirit and scope of the appended claims, giving full cognizance to equivalents in all respects.

What is claimed is:

1. A computer-implementable method for reducing halo artifacts of static images on a computer display comprising:

receiving a multimedia stream that includes graphical images;

determining if a graphical image in the multimedia stream is a static image;

turning on additional LED zones of LEDs that provide backlighting to a computer display panel;

enabling a dimming algorithm to adjust the LEDs to reduce halo artifacts in the static image; and performing luminance correction for the static image at the pixel level.

2. The method of claim 1, wherein the receiving the multimedia stream is performed by a scalar integrated circuit performing multiple operations on the multimedia stream.

3. The method of claim 1, wherein the determining if a graphical image in the multimedia stream is a static image is based on histograms of images of the multimedia stream, no change in histograms between successive images translating to a static image.

4. The method of claim 1, wherein the turning on additional LED zones of LEDs is at the edges of the static image.

5. The method of claim 1, wherein the enabling a dimming algorithm controls individual LEDs.

6. The method of claim 1, wherein the performing luminance correction is performed by a uniformity correction operation.

7. The method of claim 1, wherein an IC scalar instructs a backlight driver to perform the method.

8. A system comprising:

a processor;

a data bus coupled to the processor; and a non-transitory, computer-readable storage medium embodying computer program code, the non-transitory, computer-readable storage medium being coupled to the data bus, the computer program code interacting with a plurality of computer operations and comprising instructions executable by the processor and configured for:

receiving a multimedia stream that includes graphical images;

determining if a graphical image in the multimedia stream is a static image;

turning on additional LED zones of LEDs that provide backlighting to a computer display panel;

enabling a dimming algorithm to adjust the LEDs to reduce halo artifacts in the static image; and performing luminance correction for the static image at the pixel level.

9. The system of claim 8, wherein the receiving the multimedia stream is performed by a scalar integrated circuit performing multiple operations on the multimedia stream.

10. The system of claim 8, wherein the determining if a graphical image in the multimedia stream is a static image is based on histograms of images of the multimedia stream, no change in histograms between successive images translating to a static image.

11. The system of claim 8, wherein the turning on additional LED zones of LEDs is at the edges of the static image.

12. The system of claim 8, wherein the enabling a dimming algorithm controls individual LEDs.

13. The system of claim 8, wherein the performing luminance correction is performed by a uniformity correction operation.

14. The system of claim 8, wherein an IC scalar instructs a backlight driver to perform the instructions.

15. A non-transitory, computer-readable storage medium embodying computer program code, the computer program code comprising computer executable instructions configured for:

receiving a multimedia stream that includes graphical images;

determining if a graphical image in the multimedia stream is a static image;

turning on additional LED zones of LEDs that provide backlighting to a computer display panel;

enabling a dimming algorithm to adjust the LEDs to reduce halo artifacts in the static image; and performing luminance correction for the static image at the pixel level.

16. The non-transitory, computer-readable storage medium of claim 15, wherein the receiving the multimedia stream is performed by a scalar integrated circuit performing multiple operations on the multimedia stream.

17. The non-transitory, computer-readable storage medium of claim 15, wherein the determining if a graphical image in the multimedia stream is a static image is based on histograms of images of the multimedia stream, no change in histograms between successive images translating to a static image.

18. The non-transitory, computer-readable storage medium of claim 15, wherein the turning on additional LED zones of LEDs is at the edges of the static image.

19. The non-transitory, computer-readable storage medium of claim 15 wherein the enabling a dimming algorithm controls individual LEDs.

20. The non-transitory, computer-readable storage medium of claim 15, wherein the performing luminance correction is performed by a uniformity correction operation.

* * * * *